US008661714B2

(12) United States Patent
Sussmann

(10) Patent No.: US 8,661,714 B2
(45) Date of Patent: Mar. 4, 2014

(54) SHOE, PARTICULARLY A SPORTS SHOE

(75) Inventor: Reinhold Sussmann, Scheinfeld (DE)

(73) Assignee: Puma SE, Herzogenaurach (DE)

( * ) Notice: Subject to any disclaimer, the term of this patent is extended or adjusted under 35 U.S.C. 154(b) by 803 days.

(21) Appl. No.: 12/306,143

(22) PCT Filed: Jun. 23, 2007

(86) PCT No.: PCT/EP2007/005539
§ 371 (c)(1),
(2), (4) Date: Jan. 19, 2009

(87) PCT Pub. No.: WO2008/000398
PCT Pub. Date: Jan. 3, 2008

(65) Prior Publication Data

US 2009/0229144 A1 Sep. 17, 2009

(30) Foreign Application Priority Data

Jun. 26, 2006 (DE) ..... 20 2006 009 950 U

(51) Int. Cl.
*A43B 3/26* (2006.01)
*A43B 1/10* (2006.01)
*A43B 23/00* (2006.01)

(52) U.S. Cl.
USPC ..... 36/97; 36/102; 36/93

(58) Field of Classification Search
USPC ..... 36/97, 102, 88, 93, 7.1 R–8.1, 8.4, 112
See application file for complete search history.

(56) References Cited

U.S. PATENT DOCUMENTS

| | | | | | |
|---|---|---|---|---|---|
| 4,497 | A | * | 5/1846 | Vetter | 36/7.1 R |
| 11,947 | A | * | 11/1854 | Pease | 36/3 A |
| 3,389,481 | A | * | 6/1968 | England | 36/97 |
| 4,489,509 | A | * | 12/1984 | Libit | 36/7.1 R |
| 4,562,652 | A | * | 1/1986 | Hensler | 36/102 |
| 4,944,099 | A | * | 7/1990 | Davis | 36/97 |
| 6,138,385 | A | | 10/2000 | Jungkind | |
| 6,701,643 | B2 | | 3/2004 | Geer et al. | |
| 6,807,754 | B2 | * | 10/2004 | Miller et al. | 36/97 |
| 2005/0055849 | A1 | | 3/2005 | Ha | |
| 2005/0060913 | A1 | | 3/2005 | Chil | |

FOREIGN PATENT DOCUMENTS

| | | |
|---|---|---|
| DE | 20119907 | 4/2003 |
| DE | 10297194 | 8/2004 |
| FR | 2619490 | 2/1989 |
| JP | 2006026382 | 2/2006 |

* cited by examiner

*Primary Examiner* — Jila M Mohandesi
(74) *Attorney, Agent, or Firm* — Lucas & Mercanti, LLP

(57) ABSTRACT

The shoe is a foldable shoe with sufficient rigidity during use but allows for folding during periods of non-use. The shoe has an upper which is made of a flexible material that makes it possible to push the upper together in the longitudinal direction of the shoe. In a portion of the shoe there are reinforcing elements which run perpendicular to the longitudinal direction of the shoe and maintain the form of the shoe in a direction perpendicular to the longitudinal direction of the shoe. Rigid material is formed around the toe area and the heel area of the shoe. To make the shoe sufficiently rigid for use, an outer element that clamps onto the reinforcing elements, a stiff insole, or both is used.

18 Claims, 4 Drawing Sheets

SHOE, PARTICULARLY A SPORTS SHOE

This is a U.S. National Phase Application under 35 U.S.C. 371 of International Application PCT/JP2007/005539 filed Jun. 23, 2007, which claims the priority of German Application No. 20 2006 009 950.0, filed Jun. 26, 2006, the entire content of both Applications are hereby incorporated by reference.

The invention relates to a shoe, particularly a sports shoe, comprising a shoe top part.

In the prior art, shoes are known which are equipped with means by which the length of the shoe can be adjusted in the direction of the shoe longitudinal axis. By way of example, reference is made to U.S. Pat. No. 6,138,385. With the embodiment of a shoe sole which is shown there, the shoe size is continuously adjustable over certain regions and the shoe can thus be adapted to individual needs.

The previously known solution is not suitable when the change in the size of the shoe is intended to be made only temporarily, for example during transport. For this, other concepts have been developed. For example, DE 201 19 907 U1 discloses a sports shoe comprising a sole and a shoe top part connected thereto, which shoe top part surrounds the forefoot, the ankle region and the heel region of the foot. To enable the shoe to be easily collapsed into a format which is usable for traveling, it is there provided that the shoe top part has in the heel region an incision running in the vertical direction of the sole, those parts of the shoe top part in the heel region which are situated on both sides of the incision being configured such that they can be swung or folded inward in the direction of the sole so as to be folded up into a flat format for transportation of the shoe.

In this context, a compromise often has to be reached, since the dimensional stability of the shoe suffers as a result of the design for the collapsing of the shoe.

The object of the invention is to perfect a shoe, particularly a sports shoe, of the type stated in the introduction such that, on the one hand, a collapsing of the shoe into a small format becomes easily possible, yet such that, on the other hand, the shoe has sufficient intrinsic rigidity in normal use.

The achievement of this object by virtue of the invention is characterized in that the shoe top part, at least in portions, consists of a flexible material, which allows a compression of the shoe top part in the shoe longitudinal direction, wherein, at least in a region of the shoe top part extending in the shoe longitudinal direction, at least one reinforcing element is arranged on or in the shoe top part, which reinforcing element maintains the shape of the shoe in a section substantially perpendicular to the shoe longitudinal direction, wherein the flexible material is arranged in the connecting region between the shoe front part and the shoe rear part, wherein the shoe top part, at least in the toes region and in the heel region, consists of flexurally rigid material, and wherein the reinforcing elements, at least over the whole of the connecting region, are arranged between the shoe front part and the shoe rear part.

By this should be understood that as material for the shoe top part a thin textile material, for example, is used, which offers no fundamental resistance to a bending or buckling. In contrast, the reinforcing elements are more rigidly formed at least by a factor of 5, preferably by a factor of 10, as regards the deformation of the shoe from its usage position. The holding of the shoe in its usage position is therefore brought about almost exclusively by the reinforcing elements, not by the material of the shoe top part in the region in which the reinforcing elements are arranged.

The individual reinforcing elements—apart from a certain inclination relative to the vertical due to the anatomy of the foot—run substantially in a plane perpendicular to the shoe longitudinal direction.

According to the invention, a flexible shoe top part material is therefore provided only in the middle region of the shoe, while the heel and the tip of the shoe traditionally consist of dimensionally stable material.

The reinforcing element can preferably be configured as a closed ring running around the shoe top part or as a ring portion running around the shoe top part. A plurality of mutually parallel reinforcing elements are advantageously arranged on or in the shoe top part. These are arranged at least over the whole of the connecting region between the shoe front part and the shoe rear part. The reinforcing elements can also be arranged substantially over the whole of the region of the longitudinal extent of the shoe top part—where necessary, apart from the foremost tip region. In the shoe front part and/or in the shoe rear part, the reinforcing elements can be provided with stiffening means, which prevent or deter the compressibility of the shoe top part in the shoe longitudinal direction. These stiffening means can be formed by a web-shaped connection between two adjacent reinforcing elements. The connection between two adjacent reinforcing elements can be of wavy or fishbone-like configuration. The stiffening means can here be arranged in the floor-facing region of the reinforcing elements.

Particularly preferably, on or on the side of the shoe top part detachable stiffening means are or can be arranged, which embrace at least two adjacent reinforcing elements in a form fit and keep them apart in order to prevent or deter the compressibility of the shoe top part in the shoe longitudinal direction. The detachable stiffening means can be configured as a fit-on clamp, in particular as a clamp which can be fitted onto the instep. It can also be configured as a sole element. The detachable stiffening means here preferably has recesses, which are matched to the shape of the reinforcing elements. It can here be provided that a clip connection is arranged between the stiffening means and the reinforcing elements interacting therewith.

Said stiffening means for preventing or deterring compressibility of the shoe top part in the direction of the shoe longitudinal axis can also be configured as an intrinsically rigid insole.

Production engineering advantages are obtained if at least one reinforcing element is sprayed or pressed onto the flexible material of the shoe top part.

The adjustability of the shoe to a defined length is facilitated if, according to the refinement, it is provided that the shoe has a fixing strap, which consists of material of high tensile strength and runs around the heel of the shoe. The fixing strap can here be arranged in a guide, in particular in a material tube secured to the shoe top part.

At least one reinforcing element arranged in the instep region can consist of elastic material, which is stretchable in the peripheral direction.

The shoe upper (i.e. the material of the shoe top part) can be chosen to be water-impermeable or breathable, according to requirement. From a multiplicity of individual, circumferential or partially circumferential ribs or rings (reinforcing elements), a frame can be formed, the reinforcing elements being able to be sprayed directly onto the material of the shoe top part or pressed onto this. Appropriate materials would be, for example, thermoplastic plastics, predominantly polyamide or polyurethane, or pressed-on or sprayed-on rubber or thermoplastic rubber.

The circumferential or partially circumferential ribs can extend over the whole of the region of the upper (shoe top part) or only over part-regions of the same, for example over the forefoot and/or the ankle region.

In the lower region of the upper—as protection from external influences—material between the ribs (reinforcing elements) can also form a type of sole base. The tip and the heel section can be jointly molded on in the same process as the functional part, for example as a toecap in motor cycle boots and/or as heel caps. In this case, the remaining part of the upper can be sewn on afterwards onto the functional parts; shoes with sewn-on sole parts, in particular, are here in mind. The functional parts can, for example, have ventilation recesses or special abrasion surfaces or serve as holders for additional accessories (for example electronic components).

A stretching of the shoe top part in the shoe longitudinal direction can be achieved by a low-stretch upper material or by correspondingly non-stretch lining materials or reinforcements.

A length adjustability can be achieved by an adjustment facility, for example by said fixing strap.

In another embodiment of the invention, the frame (i.e. the arrangement of the individual reinforcing elements) is sprayed separately, the aforementioned variation options being able to be provided. The upper—configured as a moccasin—i.e. the shoe top part, is then subsequently arranged, i.e. clipped in place. In this case, the upper material has appropriate projections (sewn in or likewise sprayed on), which are clipped between the individual ribs of the frame in order to prevent too strong a displacement of the individual reinforcing elements relative to one another and also a displacement of the upper material and the frame. The shoe is thereby prevented from shortening in the shoe longitudinal direction. The advantage of this embodiment of the invention lies in the fact that the upper is exchangeable, for example for different applications.

The circumferential reinforcing elements (ribs) can basically also serve directly as a wearing surface. In order to prevent folding over of the ribs or too great a "wobble", but nevertheless continue to allow the compressibility of the shoe, there are two preferred options:

The rings can be configured in the floor region as non-straight lines, for example as concentric waves or as a fish-bone profile.

Alternatively, it is also possible for the rings to be stabilized by a negative additional sole element (stiffening means), which, via the forefoot or the back of the foot—only partially or fully covering—is "trodden" into the ribs and adheres to the ribs due to form closure or due to friction. Into this sole element acting as stiffening means, additional damping elements can also be integrated.

The adjustment of the size of the shoe and its length can be differently achieved:

Firstly, this can be ensured by means of a low-stretch upper material and reinforcing element material, i.e. the size is then defined by the maximum expansion of this material.

A fixing strap can also be provided, which runs around the heel; the band can be configured such that it is not stretchable or adjustable.

The fixing strap, which can be arranged in a material tube (formed from upper material), can run freely and can be connected at the front end to the foremost rib (reinforcing element) and can at the rear end have appropriate adjustment facilities. This type of adjustment also has the advantage that the shoe can be deliberately contracted and, by fixing of the fixing strap in a defined position, then remains in this position.

The lacing can likewise be realized differently.

A normal lacing with conventional shoe laces can, of course, be used. The ribs here end in the eye leather region to enable a contraction of the upper.

Elastic ribs can also be provided, in particular in the instep region, which adapt to the circumference of the foot.

Elastic ribs can also be provided which roughly adapt and are supported by an additional pretensioned plastics clamp for the upper. The upper clamp, configured as a clip, can here be fitted onto the shoe both from above (see subsequently following illustrative embodiment) and from below. In the case of fitting from below, the individual bars of the clip can also be very easily fastened by a molded-on central turn-lock fastener.

Yet another lacing option consists in the injection of bimetal wires into the elastic ribs (reinforcing elements). The wires are then contracted or stretched by an appropriate electrical pulse.

With the proposed embodiment of a shoe, in particular of a sports shoe, the shoe, where necessary, can be easily pushed together, so that a space-saving transportation, for example when housed in a case, is possible.

The shoe here has sufficient intrinsic rigidity and, in particular, torsional rigidity, which ensures sufficient support for the foot of the wearer. The natural freedom of movement of the foot is ensured, without any loss of protection for the foot.

A ventilation of the foot can be ensured by a sufficiently thin upper material (material of the shoe top part).

The proposed concept can be used as a basic building block for a variety of applications.

The proposed shoe perfectly duplicates the last, so that a good shoe fit is achievable.

The shoe also allows a size adjustment, for example in adolescents or children.

It is also advantageous that a relatively light shoe can be created, which comes in useful, for example, in the case of a running shoe. Furthermore—because of the "ribs"—a good protection against external forces, for example, knocks and kicks, is obtained, which is favorable, particularly when used as a football boot.

Illustrative embodiments of the invention are represented in the drawing, wherein.

Figure 1:
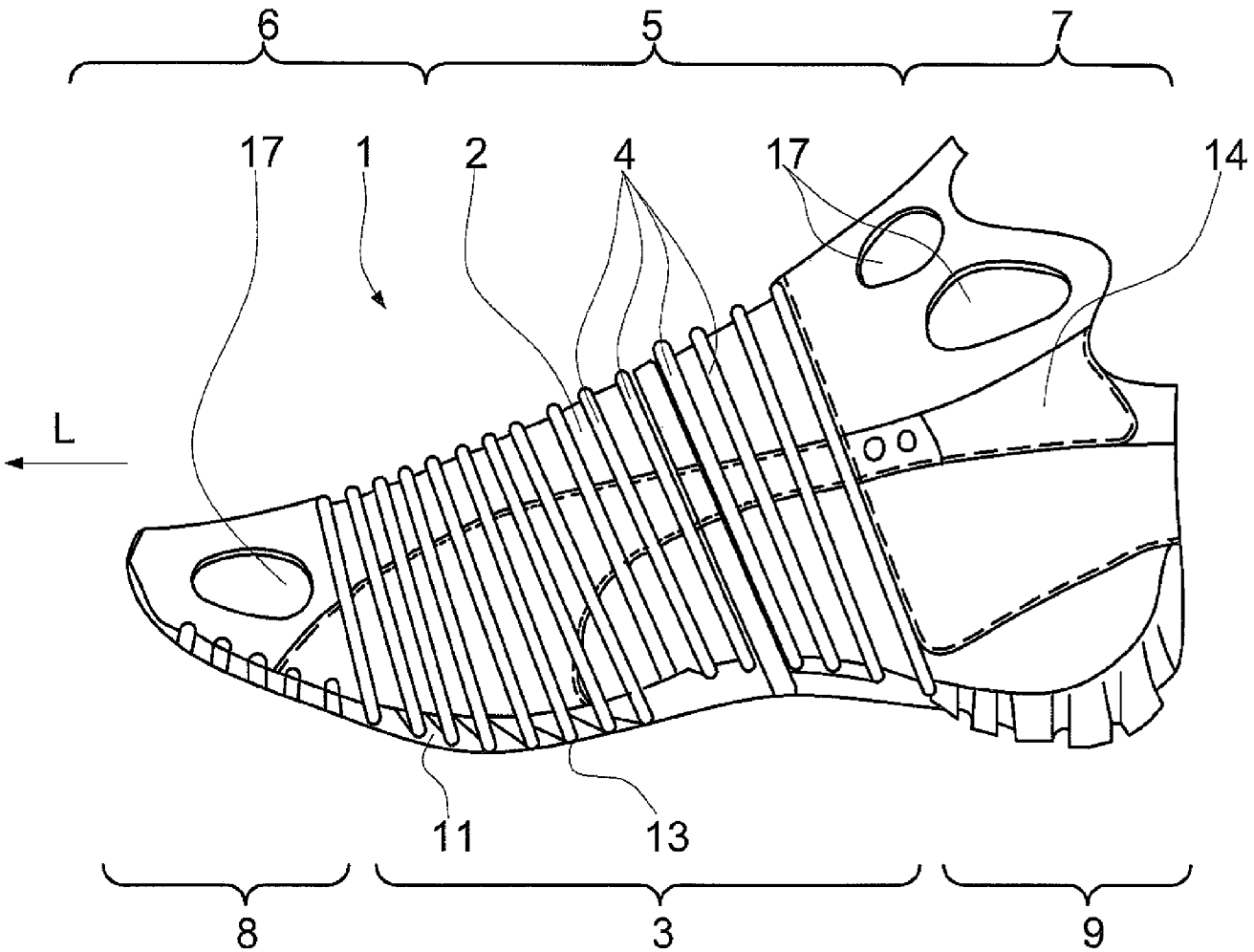
FIG. 1 shows a sports shoe in the usage position, viewed from the side.

In FIG. 1, a sports shoe 1 is represented in side view, which sports shoe, in a known manner, has a shoe top part 2. The shoe top part 2 extends in the shoe longitudinal direction L over three regions, namely over a shoe front part 6, a thereto adjoining connecting region 5 and a shoe rear part 7. The connecting region 5, in the usage state of the shoe 1, i.e. in the extended state of the shoe, here preferably extends over a distance of at least 30%, particularly preferably of at least 40%, of the overall length of the shoe 1, i.e. measured in the shoe longitudinal direction L.

A—notional—division of the shoe can also be realized by the fact that in the front shoe a toes region 8 is defined, which is adjoined by a further region 3 which is in turn bordered, in the rear shoe, by a heel region 9. In this case, correspondingly, the region 3 preferably extends over at least 30%, particularly preferably over at least 40%, of the overall length of the shoe 1 in the usage state.

The said region 3 is distinguished by the fact that along its extent the material of the shoe top part 2 is of flexible configuration. By this should be understood that the material has only a low intrinsic rigidity, is thus, for example, a thin textile material, which offers no fundamental resistance to a compression of the shoe 1 in the shoe longitudinal direction L.

Figure 2:
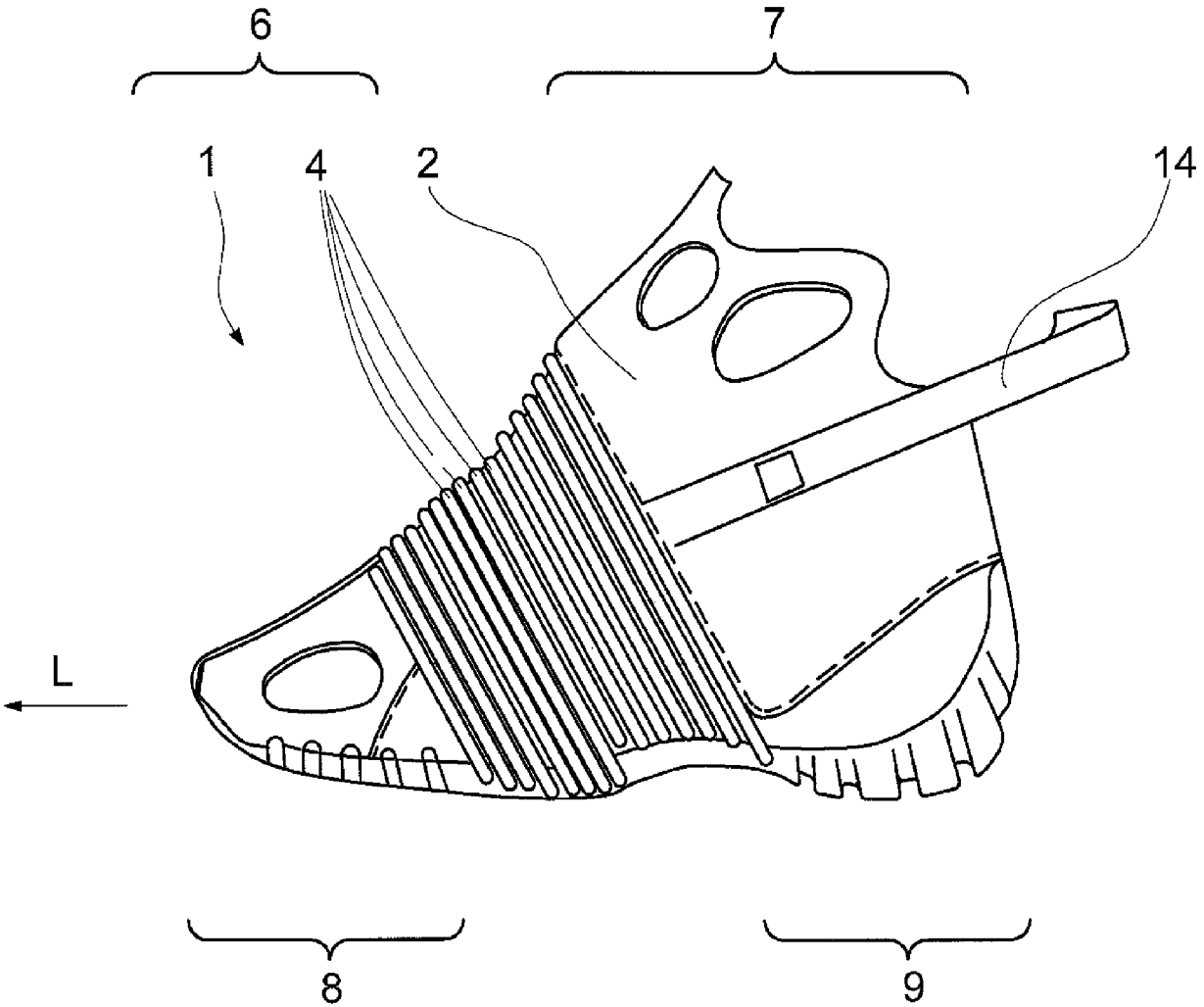
FIG. 2 shows the shoe according to FIG. 1 in a non-usage position, in which it has been collapsed into a smaller format.

The shoe 1 can also therefore be compressed out of the usage position represented in FIG. 1 into a non-usage position as represented in FIG. 2.

In order that the shoe 1, when in use, nevertheless has sufficient intrinsic rigidity and, in particular, sufficient torsional rigidity, a number of reinforcing elements 4 are provided, which are of annular configuration and run in a circle or oval pattern essentially in a plane perpendicular to the shoe longitudinal direction L. In the illustrative embodiment, the reinforcing elements 4 consist of injection-molded plastic, which is sprayed directly onto the material of the shoe top part.

As can be seen from FIG. 1, the region 3 is configured as a region of extent of the reinforcing elements 4, i.e. over the region 3 said reinforcing elements 4 are attached to the shoe top part 2.

In the illustrative embodiment according to FIG. 1, it further emerges that both the toes region 8 and the heel region 9 are traditionally configured, i.e. in this region, the shoe—as usual—consists of intrinsically rigid material.

In the synopsis of FIGS. 1 and 2, it can be seen that the shoe can be contracted in the shoe longitudinal direction L until the individual rib-shaped reinforcing elements 4 lie close together. A fixing strap 14 running around the heel of the shoe can hold the shoe 1 in the usage position in the desired (maximum) length.

In order that the shoe 1 in use, particularly in the forefoot region, has sufficient intrinsic rigidity, a front sole part 11 is provided, which is configured as stiffening means and has recesses 13, which are matched to the shape of the reinforcing elements 4 in the floor-facing region of the shoe. The ribs 4 can be forced into the recesses 13 of the stiffening means 11, so that a bond between the sole element 11 and the shoe top part 2 is established.

Figure 3:
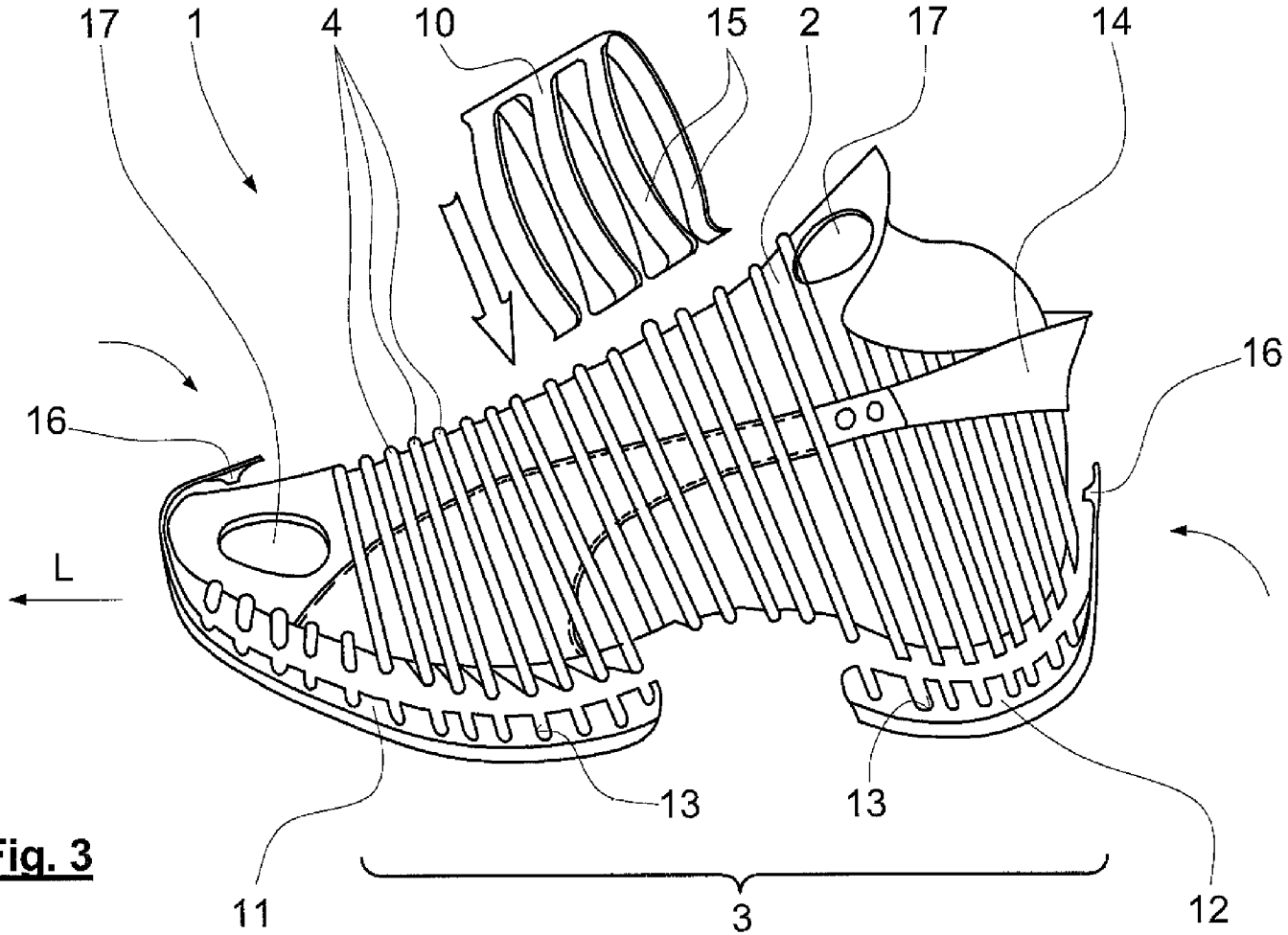
FIG. 3 shows an embodiment of the invention as an alternative to FIG. 1, having a total of three stiffening means sketched in exploded representation.

In the solution represented in FIG. 3, this principle is pursued still further: the shoe which here is represented is provided over the whole of its extent in the shoe longitudinal direction L—apart from the foremost region of the toes—with reinforcing elements 4. In order to keep the ribs 4 for the use of the shoe at the required distance apart, three stiffening means 10, 11 and 12 are provided, namely an instep clamp 10, a front sole element 11 and a rear sole element 12. The sole elements 11 and 12 again have recesses 13, which are configured for the form-fit reception of the reinforcing elements 4. In this context, a clip connection is provided between the ribs 4 and the recesses 13. By pressing-in or clipping-in of the elements 11 and 12 into the ribs 4, a defined usage position of the shoe 1 can thus be fixed in the region of the forefoot and the back of the foot. The equivalent applies to the instep clamp 10, which is fitted onto the shoe from above in the instep region and, with the arms 15, wedges itself between two adjacent reinforcing elements 4 such that these are kept at a defined distance apart.

The sole stiffening means 11 and 12 further have fastening elements 16, with which they can be fastened to the shoe top part 2, in the present case a push button connection being used. In exactly the same way, other connections of choice (for example, Velcro fasteners) can also be used for this. The attachment of the stiffening means 10, 11 and 12 to the shoe top part 2 is indicated by arrows.

Figure 4:
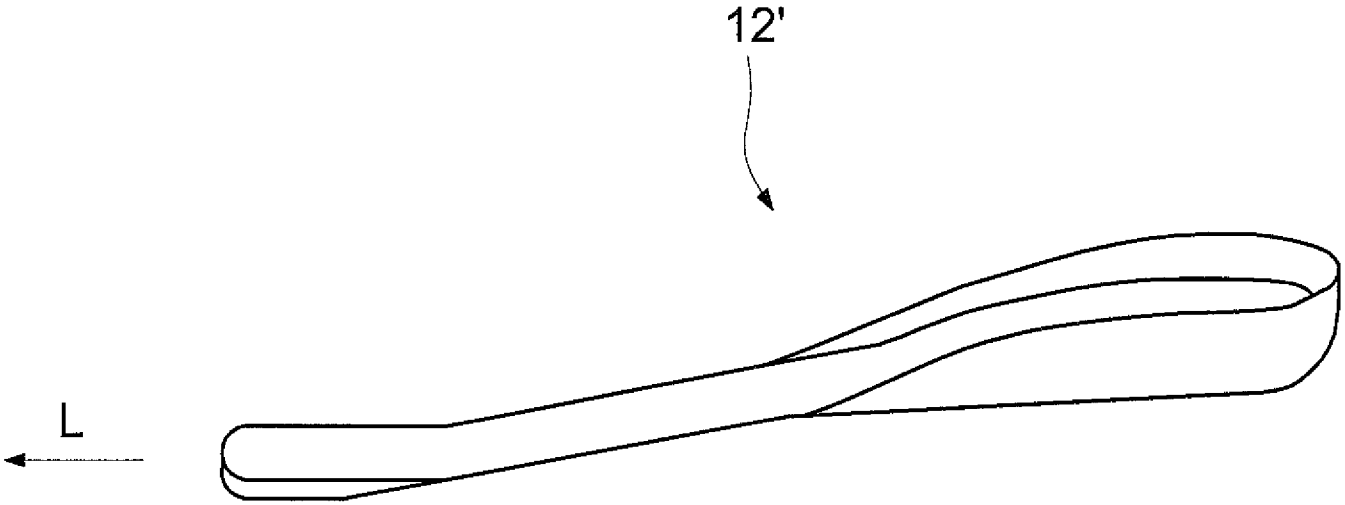
FIG. 4 shows in perspective view a stiffening means in the form of an intrinsically rigid insole for the shoe.

In FIG. 4, an intrinsically rigid insole 12' is represented, which, by way of alternative or addition, can be used as detachable stiffening means. With the insole 12', the compressibility of the shoe in the shoe longitudinal direction L can be prevented or deterred. The insole 12' is inserted as a sole element into the interior of the shoe, after the shoe has been drawn apart to its usage length. It consists preferably of plastic, of composite material or of a combination of both materials.

Damping elements can also be integrated into the sole parts 11 and 12 in order to exert a desired influence on the shoe damping.

Refinements of the shoe which are known per se, for example a ventilation opening 17 in the shoe top part 2, are not represented further.

REFERENCE SYMBOL LIST

1 shoe (sports shoe)
2 shoe top part
3 region of extent of the reinforcing elements
4 reinforcing element
5 connecting region
6 shoe front part
7 shoe rear part
8 toes region
9 heel region
10 detachable stiffening means (instep clamp)
11 detachable stiffening means (front sole)
12 detachable stiffening means (rear sole)
12' detachable stiffening means (intrinsically rigid insole)
13 recess
14 fixing strap
15 arm
16 fastening element
17 ventilation opening
L shoe longitudinal direction

The invention claimed is:

1. A collapsible shoe, comprising: a front part, a rear part and a connecting part between the front part and the rear part, in a longitudinal direction of the shoe; the front part, the rear part and the connecting part add up to an overall length of the shoe in an extended state and the connecting part extends over a distance of at least 40% of the overall length of the shoe, wherein the connecting part is greater than each of the front part and the rear part;

a shoe top part extending over the front part, the connecting part and the rear part;

a flexible material forming the shoe top part in the connecting part, the flexible material providing for compression of the shoe top part in the longitudinal direction in the connecting part of the shoe;

flexible, rigid material in the shoe top part in a toe region of the shoe and in a heel region of the shoe; and a plurality of reinforcing elements on or in the shoe top part in the connecting part, the reinforcing elements being parallel to each other and substantially perpendicular to the longitudinal direction, each of the reinforcing elements forming a closed ring around the shoe top part so that the reinforcing elements completely encircle the shoe, the reinforcing elements maintaining the shape of the shoe in a direction substantially perpendicular to the longitudinal direction of the shoe in the connecting part, such that the shoe can collapse in the connecting part of the shoe in the longitudinal direction;

wherein the plurality of reinforcing elements are formed from a material more rigid than the flexible material forming the shoe top part in the connecting part.

2. The shoe of claim 1, wherein the reinforcing elements are arranged substantially over the whole of the connecting part.

3. The shoe of claim 2, wherein the reinforcing elements are provided with stiffening elements for preventing or deterring the compression, of the shoe top part in the longitudinal direction of the shoe.

4. The shoe of claim 3, wherein the stiffening element is arranged in a floor-facing region of the reinforcing elements.

5. The shoe of claim 3, wherein the stiffening element is an intrinsically rigid insole.

6. The shoe of claim 3, wherein the stiffening element is a web-shaped connection between two adjacent reinforcing elements.

7. The shoe of claim 6, wherein the connection between two adjacent reinforcing elements has a wavy configuration.

8. The shoe of claim 6, wherein the connection between two adjacent reinforcing elements has a fishbone configuration.

9. The shoe of claim 1, wherein a detachable stiffening element for preventing or deterring the compression of the shoe top part in the longitudinal direction of the shoe can be arranged to at least partially embrace or surround at least two adjacent reinforcing elements in a form fit on or on a side of the shoe top part.

10. The shoe of claim 9, wherein the detachable stiffening element is a fit-on clamp.

11. The shoe of claim 9, wherein the detachable stiffening element is a sole element.

12. The shoe of claim 9, wherein the detachable stiffening element has recesses, which match the shape of the reinforcing elements.

13. The shoe of claim 9, wherein the stiffening element clips onto the reinforcing elements.

14. The shoe of claim 1, wherein at least one of the reinforcing elements is sprayed or pressed onto the flexible material.

15. The shoe of claim 1, wherein a fixing strap made of material of high tensile strength, runs around the heel region.

16. The shoe of claim 15, wherein the fixing strap is arranged in a guide secured to the shoe top part.

17. The shoe of claim 1, wherein at least one of the reinforcing elements is arranged in an instep region and is made of elastic material, which is stretchable in the peripheral direction.

18. The shoe of claim 1, wherein the reinforcing elements are made of plastic.

* * * * *